United States Patent [19]

Zubarev et al.

[11] 4,182,421

[45] Jan. 8, 1980

[54] PNEUMATIC ROCK DRILL

[75] Inventors: Anatoly I. Zubarev; Lev F. Osipovsky; Stanislav V. Shipov, all of Alma-Ata, U.S.S.R.

[73] Assignee: Institut Gornogo Dela Akademii Nauk Kazakhskoi SSR, U.S.S.R.

[21] Appl. No.: 857,617

[22] Filed: Dec. 5, 1977

Related U.S. Application Data

[63] Continuation of Ser. No. 676,044, Apr. 12, 1976, abandoned, which is a continuation of Ser. No. 512,308, Oct. 4, 1974, abandoned, which is a continuation of Ser. No. 391,251, Aug. 24, 1973, abandoned.

[51] Int. Cl.[2] ..... E21B 1/02

[52] U.S. Cl. ..... 173/105; 418/248

[58] Field of Search ..... 173/105, 106, 107, 108, 173/DIG. 2; 418/248

[56] References Cited

U.S. PATENT DOCUMENTS

| | | | |
|---|---|---|---|
| 2,778,605 | 1/1957 | Hunn | 173/105 |
| 3,858,666 | 1/1975 | Bailey | 173/105 |

FOREIGN PATENT DOCUMENTS

| | | | |
|---|---|---|---|
| 922121 | 3/1963 | United Kingdom | 418/248 |

*Primary Examiner*—William Pate, III

*Attorney, Agent, or Firm*—Holman & Stern

[57] ABSTRACT

A rock drill in which there is provided an impact unit, a front head with a tool holder and rotary drive means defined by a conventional pneumatic motor having a stator in the form of a cylindrical body, a rotor accommodated in said stator and having a symmetrical cam having a uniform convexo-concavo shape with lobes of said rotor cams being engaged with the inner cylindrical surface of the stator thereby forming chambers; spring-loaded vanes are accommodated in slots provided in the stator, with said vanes being engaged with the cam surface of the rotor and dividing the chambers into work chambers and idle chambers, the number of pairs of said vanes being one less than that of the chambers; each of the work chambers is in communication with channels supplying compressed air, while each of the idle chambers is in communication with channels leading to the atmosphere. Under the action of compressed air admitted into the work chambers, the rotor is rotated along with a drill bit attached thereto.

2 Claims, 6 Drawing Figures

PNEUMATIC ROCK DRILL

This is a continuation of application Ser. No. 676,044, filed Apr. 12, 1976 which in turn is A rule 60 Continuation of U.S. Ser. No. 512,308, of Oct. 4, 1974, which in turn is a Rule 60 Continuation of U.S. Ser. No. 391,251 of Aug. 24, 1973, now all abandoned.

FIELDS OF THE INVENTION

This invention relates to pneumatic rock drills with independent rotation of a drill bit designed for blast-hole drilling and for deep drilling in mining and building industries, tunneling, etc.

BACKGROUND OF THE INVENTION AND PRIOR ART

Known in the art is a rock drill with independent rotation of a drill bit comprising: an impact unit having a housing with an inner cylindrical cavity accommodating air distributing means and a hammer piston reciprocating under the action of compressed air fed into work-stroke and idle-stroke chambers of the impact unit from said air distributing means, with said hammer piston imparting blows onto the shank of the drill bit at the end of the work stroke thereof; a tool holder provided with a central opening to accommodate said shank, said tool holder being mounted on the front head of the hammer drill and adapted to prevent the drill bit from falling out of the front head; rotary drive means disposed between the impact unit and the front heat comprising a cylinder body disposed normal to the axis of the hammer drill, a piston with a slot in the intermediate portion thereof being accommodated in the inner cavity of said cylindrical body, said piston reciprocating under the action of the compressed air admitted alternatively from the work-stroke chamber and the idle-stroke chamber of the impact unit into the idle and work chambers of said rotary drive means respectively, thereby bringing into motion a lever inserted into the slot of the piston, with said lever being formed integrally with a ratchet wheel engaging pawls mounted in the tool holder which transmits its rotation to the shank of the drill bit.

Thus, the above-disclosed rotary drive means for a rock drill is provided with a ratchet mechanism converting the pivotal movement of the lever imparted thereto from the piston into a rotational movement which is transmitted to the shank of the drill bit by means of the tool holder.

The above-described technical solution complicates the structure of the rotary drive means and makes it unreliable in operation.

Furthermore, a lack of reversing rotations of a drill bit makes it impossible to mechanize the dismounting of a drill string in deep drilling operations.

There is also known in the art a rock drill with independent rotation of a drill bit comprising: two impact units, each being provided with a housing having an inner cylindrcal cavity accommodating a hammer piston reciprocating under the action of compressed air and imparting at the end of its work stroke, blows to one of drill bit shoulders; a front head with the shank of the drill bit being journalled in bearings in said front head and abutting via its shoulder, a spring-loaded flange disposed in the inner cavity of said front head; a tool holder having a central opening to accommodate said shank and adapted to prevent said shank from falling out of the front head; rotary drive means comprising a rotary pneumatic motor having a stationary stator and a rotor journalled in bearings and provided with vanes moved outwardly under the action of centrifugal forces, with said vanes defining work and idle chambers and rotating along with the rotor under the action of compressed air; and a planetary gear with a system of toothed gears reducing the rotational speed of the rotor up to an optimal value and transmitting rotation to the shank of the drill bit (cf. a double-piston hammer drill produced by the firm "Hausgerr").

The provision in this rock drill of a double-piston impact until, a rotary motor, a planetary gear, some pairs of ball bearings and sliding bearings makes it difficult to manufacture, increases its weight and reduces the efficiency of the machine, while a lack of reversing rotation of a drill string makes it impossible to mechanize the dismounting of the drill string in deep drilling operations.

OBJECTS AND SUMMARY OF THE INVENTION

An object of the present invention is to provide a rock drill with a simple structure of rotary drive means.

Another object of the invention is to provide a rock drill which is reliable in operation. It is another object of the invention is to provide a rock drill of a lower weight.

Still another object of the invention is to provide a rock drill with a minimal number of parts and relatively movable surfaces, thereby increasing the efficiency of the machine.

It is another object of the invention to provide a rock drill having a reversible rotation of a drill bit which makes it possible to increase the labor productivity due to mechanization of operations for running and pulling the drill strings in deep drilling.

These and other object of the invention are achieved by the provision of a pneumatic rock drill with independent rotation of a drill bit comprising an impact unit having a housing with an inner cylindrical cavity accommodating air distributing means and a hammer piston adapted to reciprocate under the action of compressed air and to transmit blows to the shank of the drill bit at the end of the work stroke thereof, a front head accommodating the shank of the drill bit disposed coaxially with the hammer piston, a tool holder with a central opening for said drill bit shank mounted on said front head, and means to rotate the drill bit. According to the invention, a conventional pneumatic motor is used as rotary drive means, with said motor comprising a stator in the form of a cylindrical body, a rotor having a cam surface disposed inside the stator so as lobes of the cam surface are arranged along the cylinder of the stator and are engaged with the inner cylindrical surface thereof they define chambers, spring-loaded vanes located in slots of the stator and engaging the cam surface of the rotor, said vanes dividing the chambers into work and idle chambers with the number of pairs of said vanes being one less than that of the chambers, each of the work chambers being in communication with channels supplying compressed air, with each of said idle chambers being in communication with channels discharging spent air into the atmosphere, said rotor being rotated along with said drill bit attached thereto under the action of the compressed air fed into said work chambers.

It is advantageous to connect the channels supplying compressed air to the work chambers and the channels discharging spent air from the idle chambers with a valve interconnected with a compressed air main and with the atmosphere, so that upon switching the valve between operating positions, the channels for the idle chambers are placed in communication with the compressed air main and the channels for the work chambers are placed in communication with the atmosphere thereby converting the idle chambers into the work chambers and reversing the rotation of the rotor.

This invention provides an improved rock drill having a simple structure of rotary drive means which is reliable, light in weight and efficient in operation making it possible to increase the labor productivity due to mechanization of operations for pulling and running the drill strings in deep drilling.

The invention will now be explained in greater detail with reference to an embodiment thereof which is represented in the accompanying drawings, wherein:

DESCRIPTION OF A PREFERRED EMBODIMENT

Figure 1:
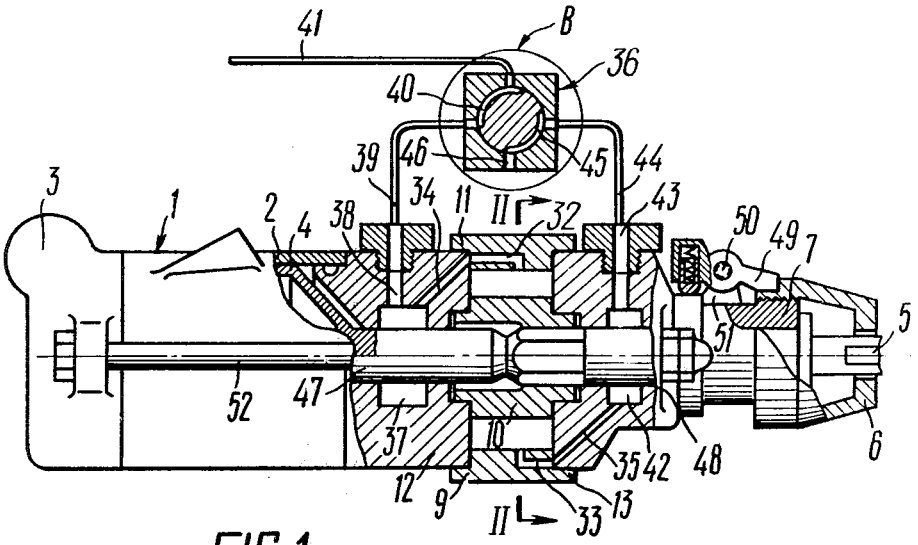
FIG. 1 is a partial longitudinal sectional view of a rock drill in accordance with the present invention.
Figure 2:
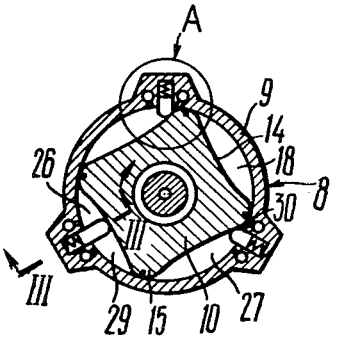
FIG. 2 is a view along lines II—II in FIG. 1, the view looking in the direction of the arrows.
Figure 3:
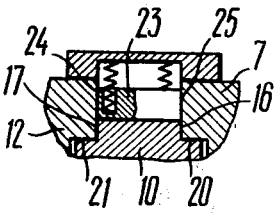
FIG. 3 is a view along lines III—III in FIG. 2, the view looking in the direction of the arrows.

Referring to FIGS. 1-6, a rock drill with independent rotation of a drill bit comprises an impact unit 1 (FIG. 1) having a housing 2 with an inner cylindrical surface accommodating air distributing means 3 of any known and suitable structure and a hammer piston 4, having a forward end defining an impact hammer 47, the piston reciprocating in said housing under the action of compressed air and transmitting a blow at the end of its work stroke to the shank 5 of a drill bit mounted in a tool holder 6 attached to a front head 7 of a rock drill.

The rock drill is provided with rotary drive means 8 (FIG. 2) consisting of a stator 9 (FIGS. 1 and 2) made in the form of a cylindrical stator housing and a rotor 10 disposed within the stator 9. The stator is fitted by means of first projections 11 over the outer surface of housing 12 of an air distributor placed at the rear of the stator and by means of second projections 13 it is fitted over the outer surface of the front head 7 positioned in front of said housing.

The rotor 10 accommodated inside the stator 9 has a cam surface 14 (FIGS. 2 and 4) and is arranged inside the stator so as lobes 15 of the cam surface are directed along the cylinder of the stator engaging with the inner cylindrical surface thereof, while front end faces 16 and the rear end faces 17 of the lobes (FIG. 3) are in constant engagement with corresponding surfaces of the front head 7 and the housing of the air distributor respectively thereby defining four chambers 18.

Figure 6:
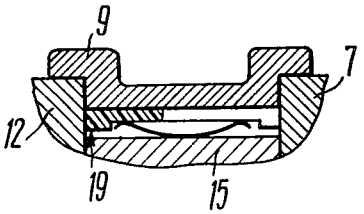
FIG. 6 is a view along lines VI—VI in FIG. 4, the view looking in the direction of the arrows.

To seal the zone of a contact between the lobes 15 and the inner cylindrical surface of the stator, the lobes 15 are provided with spring-loaded vanes 19 (FIG. 6).

Surfaces 20 and 21 (FIG. 3) of the rotor bear up against associated surfaces of the front head 7 and of the air distributor housing 12 defining sliding bearings.

The stator 9 is provided with longitudinally extending slots 22 (FIG. 4) and spring-loaded vanes 23 (FIGS. 3 and 4) are loosely fitted in said slots, with the vanes 23 being in the form of plates substantially rectangular in shape engaging with their rounded ends the cam surface 14 (FIGS. 2 and 4) of the rotor 10 and at the same time sliding with their end faces 24 and 25 (FIG. 3) over associated end faces of the housing 12 of the air distributor and of the front head 7 respectively dividing the four chambers 18 into three work chambers 26, 27 and 28 (FIGS. 2 and 4) fed by compressed air and three idle chambers 29, 30 and 31 discharging spent air into the atmosphere.

First and second air conduit means are provided for admitting compressed air to and exhausting air from the stator housing and provide rotation of the rotor. To this end channels 32 and 33 (FIGS. 1 and 4) are provided in the stator 9, with said channels being in communication with associated channels 34 and 35 (FIG. 1) formed in the air distributor housing 12 and the front head 7 respectively.

A valve 36 is provided in the rock drill to reverse the direction of compressed air flow fed to the work and idle chambers of the rotary drive means.

In the position of the valve 36 shown in FIG. 1, the channels 34 in the housing 12 are in communication with a compressed air main 41 via an annular groove 37, bore 38, pipe 39 and a groove 40 of the valve 36.

The channels 35 of the front head 7 are in communication with the atmosphere via an annular groove 42, a bore 43 of the front head, pipe 44, groove 45 of the valve 36 and a port 46 of the valve. In this position of the valve 36 during operation of the rock drill, the rotor 10 will be rotated in the clockwise direction. As clearly seen in FIG. 1 the annular grooves 37 and 42 are defined between the peripheral surfaces of the impact hammer and drill bit shank respectively and inner surfaces of the air distributor housing and front head.

To ensure counter-clockwise rotation of the rotor 10, the valve 36 should be rotated to a position in which the pipe 44 is placed in communication with the compressed air main 41 through the groove 45, while the pipe 39 is placed in communication with the port 46 (i.e., with the atmosphere) through the groove 40. In this position the work chambers 26, 27 and 28 are placed in communication with the atmosphere (that is, become idle chambers), while the idle chambers 29, 30 and 31 are placed in communication with the main 41 (that is, become work chambers).

The sealing of the air inlet channels 32 and 34 (FIG. 1) is ensured by a stem portion 47 of the hammer piston 4 which is loosely fitted in the associated opening of the air distributor housing 12. The sealing of the air outlet channels 33 and 35, in turn, is ensured by a cylindrical surface 48 of the shank 5 loosely fitted in the associated opening of the front head 7.

The tool holder 6 (FIG. 1) is mounted on the front head 7, with the axial movement of the tool holder being limited by a stop 49 mounted on a pivot 50 located in lugs or ears 51 formed on the front head 7. The impact unit 1, rotary drive means 8 and the front head are held together by pinch bolts 52.

Upon starting the rock drill, the hammer piston 4 starts to reciprocate under the action of compressed air fed from the air distributing means 3 (FIG. 1). At the end of its work stroke, the hammer piston transmits blows to the shank 5 of the drill bit which is held in the front head 7 by the tool holder 6. Unscrewing of the tool holder 6 under operating conditions is prevented by the spring-loaded stop 49.

Compressed air is admitted into the work chambers 26, 27 and 28 of the rotary drive means 8 from the main 41 via the groove 40 of the valve 36, pipe 39, bore 38 in the air distributor housing 12, annular groove 37, channels 34 of the air distributor housing 12 and channels 32 of the stator.

Figure 4:
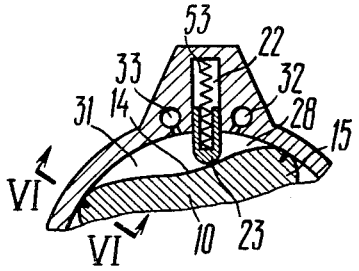
FIG. 4 is an enlarged fragmentary view of a portion of the device indicated by letter "A" in FIG. 2 (a lobe of the rotor and a vane)
Figure 5:
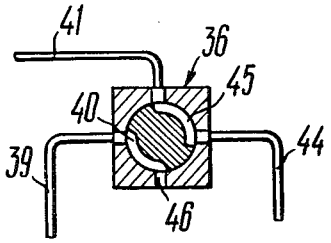
FIG. 5 is a view of a portion of the device indicated by letter "B" in FIG. 1 (a position of a valve for reversing the rotation)

When entering these work chambers, compressed air acts with equal forces upon the spring-loaded vanes 23 and the lobes 15 of the rotor 10. Under the action of compressed air, the rotor is rotated in the clockwise direction (as shown by the arrow in FIG. 2) with a constant sliding engagement against the cylindrical surface of the stator. During this rotation, the spring-loaded vanes 23 engaging the cam surface 14 of the rotor 10 reciprocate in the radially extended slots 22 of the stator 9 against springs 53 (FIG. 4).

When the lobe 15 of the rotor 10 is aligned with the spring-loaded vane 23, the vane 23 is moved completely into the slot 22 of the stator 9 thereby eliminating the work and idle chambers associated with this vane. The rotation of the rotor at this moment is cntinued under the action of air remaining in the rest of two work chambers.

The rotation of the rotor 10 is transmitted to the shank 5 of the drill bit which is inserted into an associated opening of the rotor 10.

Spent air is discharged into the atmosphere from the idle chambers 29, 30 and 31 of the rotary drive means 8 via the channels 33 of the stator and the channels 35 of the front head 7, annular groove 42, bore 43, pipe 44, groove 45 of the valve 36 and the port 46 of the valve 46.

To reverse the rotation of the drill bit the valve 36 (FIG. 5) should be rotated to a position in which the groove 45 provides communication between the pipe 44 and the air main 41 while the groove 40 provides communication between the pipe 39 and the port 46 leading to the atmosphere. In this case, compressed air from the air main 41 flows through the groove 45, pipe 44, bore 43, annular groove 42, channel 35 and the channel 33 of the stator into the chambers 29, 30 and 31 of the rotary drive means imparting counter-clockwise rotation of the rotor 10 and the shank 5 of the drill bit attached thereto.

The chambers 26, 27, 28 are connected to the atmosphere via the channels 32 of the stator 9, channels 34 of the air distributor housing 12, annular groove 37, bore 38, pipe 39 (FIG. 5), groove 40 and the port 46 of the valve.

In this manner, the reversing rotation of the rotor 10 along with the shank 5 of the drill bit is effected.

The rotational speed of the rotor may be adjusted in any known manner, such as by means of a throttle (not shown) connected in the air main or mounted on the valve. The throttle may be of any suitable type.

What is claimed is:

1. A reversible pneumatic rock drill comprising an impact unit including an impact housing, a hammer piston disposed in said impact housing, air distributing means for reciprocating said hammer in said impact housing, an air distributor housing at one end of said impact unit, said impact piston having a forward end portion defining an impact hammer disposed in said air distributor housing, a front head assembly including a front head housing, a drill bit shank disposed in said front head housing, said drill bit shank being coaxial with said impact hammer and having a rear end disposed adjacent a forward end of said impact hammer to be struck by said impact hammer during reciprocatory movements of said impact piston, pneumatic motor means for reversibly rotating said drill bit shank including a stator housing disposed between and connecting said air distributor housing and said front head assembly, a rotor disposed within said stator housing, said rotor embracing and being directly attached to said drill bit shank for rotation therewith, and air supply means for admitting air into said stator housing and exhausting air from said stator housing to effect rotation of said rotor within said stator housing, said air supply means including first air conduit means formed in said air distributor housing and having a first annular chamber defined by a peripheral surface of said impact hammer and a surface of said air distributor housing, second air conduit means formed in said front head assembly and having a second annular chamber defined by a peripheral surface of said drill bit shank and a surface of said front head assembly and reversible valve means for selectively directing a source of pressurized air into said stator housing through one of said first and second conduit means and to leave said stator housing through the other of said first and second conduit means whereby the direction of rotation of said rotor and said drill bit shank can be reversed.

2. The rock drill of claim 1 wherein said rotor comprises a multi-lobe cam including spaced peripheral sprung vanes urged into contact with an internal surface of said stator housing to define work chambers and idle chambers therebetween communicating with said first and second conduit means for the admission and exhaust of air for operating said motor means.

* * * * *